US010597760B2

(12) United States Patent
Kobayashi et al.

(10) Patent No.: US 10,597,760 B2
(45) Date of Patent: Mar. 24, 2020

(54) HIGH-STRENGTH STEEL MATERIAL FOR OIL WELL AND OIL WELL PIPES

(71) Applicant: NIPPON STEEL & SUMITOMO METAL CORPORATION, Tokyo (JP)

(72) Inventors: Kenji Kobayashi, Tokyo (JP); Yusaku Tomio, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 387 days.

(21) Appl. No.: 14/904,967

(22) PCT Filed: Jul. 24, 2014

(86) PCT No.: PCT/JP2014/069580
§ 371 (c)(1),
(2) Date: Jan. 14, 2016

(87) PCT Pub. No.: WO2015/012357
PCT Pub. Date: Jan. 29, 2015

(65) Prior Publication Data

US 2016/0168672 A1 Jun. 16, 2016

(30) Foreign Application Priority Data

Jul. 26, 2013 (JP) ..... 2013-155845

(51) Int. Cl.

| | |
|---|---|
| ***C22C 38/04*** | (2006.01) |
| ***C22C 38/58*** | (2006.01) |
| ***C22C 38/00*** | (2006.01) |
| ***C22C 38/02*** | (2006.01) |
| ***C22C 38/06*** | (2006.01) |
| ***C22C 38/42*** | (2006.01) |
| ***C22C 38/44*** | (2006.01) |
| ***C21D 8/02*** | (2006.01) |
| ***C22C 38/22*** | (2006.01) |
| ***C22C 38/08*** | (2006.01) |
| ***C22C 38/38*** | (2006.01) |
| ***C22C 38/16*** | (2006.01) |
| ***C21D 8/10*** | (2006.01) |
| ***C22C 38/12*** | (2006.01) |
| ***C22C 38/14*** | (2006.01) |
| ***C21D 6/00*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***E21B 17/00*** | (2006.01) |

(52) U.S. Cl.

CPC ..... *C22C 38/58* (2013.01); *C21D 6/005* (2013.01); *C21D 8/0236* (2013.01); *C21D 8/0247* (2013.01); *C21D 8/10* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/22* (2013.01); *C22C 38/38* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *E21B 17/00* (2013.01); *C21D 2211/001* (2013.01)

(58) Field of Classification Search

CPC ..... C22C 38/04

See application file for complete search history.

(56) References Cited

U.S. PATENT DOCUMENTS

| | | | | |
|---|---|---|---|---|
| 2002/0048529 | A1 | 4/2002 | Kucharczyk et al. | |
| 2009/0074605 | A1* | 3/2009 | Kim | C22C 38/04 420/75 |
| 2011/0308673 | A1* | 12/2011 | Schneider | C21D 6/005 148/546 |
| 2014/0373588 | A1* | 12/2014 | Lee | C22C 38/002 72/200 |

FOREIGN PATENT DOCUMENTS

| | | |
|---|---|---|
| CA | 2595609 | 7/2006 |
| CN | 102828109 | 12/2012 |
| FR | 2881144 | 7/2006 |
| JP | 58-174557 | 10/1983 |
| JP | 59-232220 | 12/1984 |
| JP | 60-039150 | 2/1985 |
| JP | 61-009519 | 1/1986 |
| JP | 63-093822 | 4/1988 |
| JP | 04-259325 | 9/1992 |

(Continued)

OTHER PUBLICATIONS

English machine translation of JP 2013-023743 A (Year: 2013).*

*Primary Examiner* — Jophy S. Koshy

(74) *Attorney, Agent, or Firm* — Clark & Brody

(57) ABSTRACT

There is provided a high-strength steel material for oil well having a chemical composition consisting, by mass percent, of C: 0.60-1.4%, Si: 0.05-1.00%, Mn: 12-25%, Al: 0.003-0.06%, P: ≤0.03%, S: ≤0.03%, N: <0.1%, Cr: ≥0% and <5.0%, Mo: ≥0% and <3.0%, Cu: ≤0% and <1.0%, Ni: ≥0% and <1.0%, V: 0-0.5%, Nb: 0-0.5%, Ta: 0-0.5%, Ti: 0-0.5%, Zr: 0-0.5%, Ca: ≥0% and <0.005%, Mg: ≥0% and <0.005%, B: 0-0.015%, the balance: Fe and impurities, wherein Nieq [=Ni+30C+0.5Mn] is 27.5 or higher, a metal micro-structure is a structure consisting mainly of an FCC structure, a total volume fraction of ferrite and α' martensite is less than 0.10%, and a yield strength is 862 MPa or higher.

6 Claims, 1 Drawing Sheet

(56) References Cited

FOREIGN PATENT DOCUMENTS

| | | | | |
|---|---|---|---|---|
| JP | 07-126809 | | 5/1995 | |
| JP | 09-249940 | | 9/1997 | |
| JP | 10-121202 | | 5/1998 | |
| JP | 2013-023743 | | 2/2013 | |
| WO | 2012/092122 | | 7/2012 | |
| WO | WO-2013100612 | A1 * | 7/2013 | ..... C22C 38/002 |

* cited by examiner

HIGH-STRENGTH STEEL MATERIAL FOR OIL WELL AND OIL WELL PIPES

TECHNICAL FIELD

The present invention relates to a high-strength steel material for oil well and oil well pipes, and more particularly, to a high-strength steel material for oil well excellent in sulfide stress cracking resistance, which is used in oil well and gas well environments and the like environments containing hydrogen sulfide ($H_2S$) and oil well pipes using the same.

BACKGROUND ART

In oil wells and gas wells (hereinafter, collectively referred simply as "oil wells") of crude oil, natural gas, and the like containing $H_2S$, sulfide stress-corrosion cracking (hereinafter, referred to as "SSC") of steel in wet hydrogen sulfide environments poses a problem, and therefore oil well pipes excellent in SSC resistance are needed. In recent years, the strengthening of low-alloy sour-resistant oil well pipes used in casing applications has been advanced.

The SSC resistance deteriorates sharply with the increase in steel strength. Therefore, conventionally, steel materials capable of assuring SSC resistance in the environment of NACE solution A (NACE TM0177-2005) containing 1-bar $H_2S$, which is the general evaluation condition, have been steel materials of 110 ksi class (yield strength: 758 to 862 MPa) or lower. In many cases, higher-strength steel materials of 125 ksi class (yield strength: 862 to 965 MPa) and 140 ksi class (yield strength: 965 to 1069 MPa) can only assure SSC resistance under a limited $H_2S$ partial pressure (for example, 0.1 bar or lower). It is thought that, in the future, the corrosion environment will become more and more hostile due to larger depth of oil well, so that oil well pipes having higher strength and higher corrosion resistance must be developed.

The SSC is a kind of hydrogen embrittlement in which hydrogen generated on the surface of steel material in a corrosion environment diffuses in the steel, and resultantly the steel material is ruptured by the synergetic effect with the stress applied to the steel material. In the steel material having high SSC susceptibility, cracks are generated easily by a low load stress as compared with the yield strength of steel material.

Many studies on the relationship between metal micro-structure and SSC resistance of low-alloy steel have been conducted so far. Generally, it is said that, in order to improve SSC resistance, it is most effective to turn the metal micro-structure into a tempered martensitic structure, and it is desirable to turn the metal micro-structure into a fine grain structure.

For example, Patent Document 1 proposes a method which refines the crystal grains by applying rapid heating means such as induction heating when the steel is heated. Also, Patent Document 2 proposes a method which refines the crystal grains by quenching the steel twice. Besides, for example, Patent Document 3 proposes a method which improve the steel performance by making the structure of steel material bainitic. All of the object steels in many conventional techniques described above each have a metal micro-structure consisting mainly of tempered martensite, ferrite, or bainite.

The tempered martensite or ferrite, which is the main structure of the above-described low-alloy steel, is of a body-centered cubic system (hereinafter, referred to as a "BCC"). The BCC structure inherently has high hydrogen embrittlement susceptibility. Therefore, for the steel whose main structure is tempered martensite or ferrite, it is very difficult to prevent SSC completely. In particular, as described above, SSC susceptibility becomes higher with the increase in strength. Therefore, it is said that to obtain a high-strength steel material excellent in SSC resistance is a problem most difficult to solve for the low-alloy steel.

In contrast, if a highly corrosion resistant alloy such as stainless steel or high-Ni alloy having an austenitic structure of a face-centered cubic system (hereinafter, referred to as an "FCC"), which inherently has low hydrogen embrittlement susceptibility, is used, SSC can be prevented. However, the austenitic steel generally has a low strength as is solid solution treated. Also, in order to obtain a stable austenitic structure, usually, a large amount of expensive component element such as Ni must be added, so that the production cost of steel material increases remarkably.

Manganese is known as an austenite stabilizing element. Therefore, the use of austenitic steel containing much Mn as a material for oil well pipes in place of expensive Ni has been considered. Patent Document 4 discloses a technique in which a steel containing C: 0.3 to 1.6%, Mn: 4 to 35%, Cr: 0.5 to 20%, V: 0.2 to 4%, Nb: 0.2 to 4%, and the like is used, and the steel is strengthened by precipitating carbides in the cooling process after solid solution treatment. Also, Patent Document 5 discloses a technique in which a steel containing C: 0.10 to 1.2%, Mn: 5.0 to 45.0%, V: 0.5 to 2.0%, and the like is subjected to aging treatment after solid solution treatment, and the steel is strengthened by precipitating V carbides. Further, Patent Document 6 discloses a steel that contains C: 1.2% or less, Mn: 5 to 45%, and the like and is strengthened by cold working.

LIST OF PRIOR ART DOCUMENTS

Patent Document

Patent Document 1: JP61-9519A
Patent Document 2: JP59-232220A
Patent Document 3: JP63-93822A
Patent Document 4: JP60-39150A
Patent Document 5: JP9-249940A
Patent Document 6: JP10-121202A

DISCLOSURE OF THE INVENTION

Problems to be Solved by the Invention

Since the austenitic steel generally has a low strength, in Patent Documents 4 and 5, the steel is strengthened by the precipitation of carbides. However, to realize high strength, aging must be performed for a considerably long period of time, and the long-term aging is not necessarily favorable from the viewpoint of productivity.

In Patent Document 6, a yield stress a bit larger than 100 $kgf/mm^2$ is attained by performing cold working of 40% working ratio. However, the result of study conducted by the present inventors revealed that, in the steel of Patent Document 6, $\alpha'$ martensite is formed by strain induced transformation due to the increase in degree of cold working, and the SSC resistance is sometimes deteriorated. Also, for the steel of Patent Document 6, elongation is decreased sharply with the increase in degree of cold working, and the workability is decreased, so that there remains room for improvement.

An objective of the present invention is to provide a high-strength steel material for oil well and oil well pipes using the same that is excellent in SSC resistance, has corrosion resistance as high as that of low-alloy steel from the viewpoint of general corrosion, and moreover, has a high economic efficiency, and is capable of being produced without much trouble by using the conventional industrial facility.

Means for Solving the Problems

As described above, SSC is a kind of hydrogen embrittlement. The present inventors conducted studies, as in the invention of Patent Document 6, to form austenite phase by using a relatively large amount of Mn, and to increase the steel strength by means of cold working. However, as described above, in Patent Document 6, in order to realize the yield stress of 125 ksi class, the working ratio of about 40% is required, which is subject to the restriction of facility.

The present inventors focused a region containing large amounts of austenite phase stabilizing elements, that is, a region in which Ni equivalent (Nieq=Ni+30C+0.5Mn) defined in the present invention is high, which region has been unconfirmed conventionally, and examined the practical performance of the region. As the result, the present inventors came to obtain the following findings.

(A) By increasing mainly the contents of C and Mn for Nieq of 27.5 or higher, high strength can be realized even at a relatively low working ratio, and the structure ratio of BCC structure can be restrained even after heavy working, so that the SSC resistance can be assured.

(B) By increasing mainly the contents of C and Mn for Nieq of 27.5 or higher, large elongation can be maintained even after heavy working, and the occurrence of fine cracks on the surface can be prevented, so that cold working can be performed reasonably even at a high working ratio.

(C) When the value of Nieq is increased, if the content of Mn is excessive, the general corrosion resistance is deteriorated.

(D) Although Ni contributes to the stabilization of austenite, if Ni is contained excessively, the SSC resistance deteriorates in a high-strength material.

The present invention has been accomplished on the basis of the above-described findings, and involves the high-strength steel material for oil well and oil well pipes described below.

(1) A high-strength steel material for oil well having a chemical composition consisting, by mass percent, of C: 0.60 to 1.4%,
Si: 0.05 to 1.00%,
Mn: 12 to 25%,
Al: 0.003 to 0.06%,
P: 0.03% or less,
S: 0.03% or less,
N: less than 0.1%,
Cr: 0% or more and less than 5.0%,
Mo: 0% or more and less than 3.0%,
Cu: 0% or more and less than 1.0%,
Ni: 0% or more and less than 1.0%,
V: 0 to 0.5%,
Nb: 0 to 0.5%,
Ta: 0 to 0.5%,
Ti: 0 to 0.5%,
Zr: 0 to 0.5%,
Ca: 0% or more and less than 0.005%,
Mg: 0% or more and less than 0.005%,
B: 0 to 0.015%,
the balance: Fe and impurities, wherein Nieq defined by the following Formula (i) is 27.5 or higher, a metal micro-structure is a structure consisting mainly of an FCC structure, a total volume fraction of ferrite and α' martensite is less than 0.10%, and a yield strength is 862 MPa or higher;

$$Nieq=Ni+30C+0.5Mn \quad (i)$$

where, the symbol of an element in the formula represents the content (mass %) of the element contained in the steel material, and is made zero in the case where the element is not contained.

(2) The high-strength steel material for oil well according to (1), wherein the chemical composition contains, by mass percent, one or two elements selected from Cr: 0.1% or more and less than 5.0% and Mo: 0.1% or more and less than 3.0%.

(3) The high-strength steel material for oil well according to (1) or (2), wherein the chemical composition contains, by mass percent, one or two elements selected from Cu: 0.1% or more and less than 1.0% and Ni: 0.1% or more and less than 1.0%.

(4) The high-strength steel material for oil well according to any one of (1) to (3), wherein the chemical composition contains, by mass percent, one or more elements selected from V: 0.005 to 0.5%,
Nb: 0.005 to 0.5%,
Ta: 0.005 to 0.5%,
Ti: 0.005 to 0.5% and
Zr: 0.005 to 0.5%.

(5) The high-strength steel material for oil well according to any one of (1) to (4), wherein the chemical composition contains, by mass percent, one or two elements selected from Ca: 0.0003% or more and less than 0.005% and Mg: 0.0003% or more and less than 0.005%.

(6) The high-strength steel material for oil well according to any one of (1) to (5), wherein the chemical composition contains, by mass percent, B: 0.0001 to 0.015%.

(7) The high-strength steel material for oil well according to any one of (1) to (6), wherein the yield strength is 965 MPa or higher.

(8) Oil well pipes, which are comprised of the high-strength steel material for oil well according to any one of (1) to (7).

Advantageous Effects of the Invention

According to the present invention, a steel material having a high strength and excellent SSC resistance can be obtained at a low cost by using the conventional industrial facility. Additionally, because of being also excellent in elongation, the steel material of the present invention is excellent in workability. Therefore, the high-strength steel material for oil well according to the present invention can be used suitably for oil well pipes in wet hydrogen sulfide environments.

MODE FOR CARRYING OUT THE INVENTION

Figure 1:
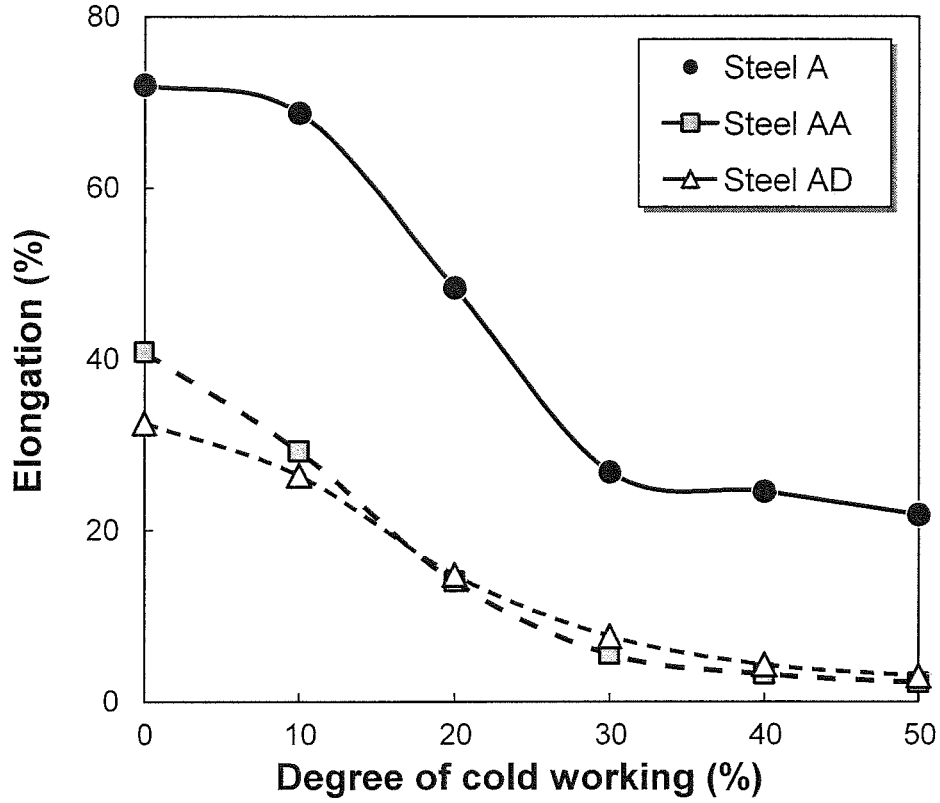
FIG. 1 is a graph showing the relationship between degree of cold working and elongation.

Components of the present invention is described below in detail.

1. Chemical Composition

The reasons for restricting the elements are as described below. In the following explanation, the symbol "%" for the content of each element means "% by mass".

C: 0.60 to 1.40%

Carbon (C) has an effect of stabilizing austenite phase at a low cost even if the content of Mn or Ni is reduced, and also can improve the work hardening property and uniform elongation by means of promotion of plastic deformation by twinning, so that C is a very important element in the present invention. Therefore, 0.60% or more of C has to be contained. On the other hand, if the content of C is too high, cementite precipitates, and thereby not only the grain boundary strength is decreased and the stress corrosion cracking susceptibility is increased, but also the fusing point of material is decreased remarkably and the hot workability is deteriorated. Therefore, the C content is set to 1.40% or less. In order to obtain the high-strength steel material for oil well excellent in balance of strength and elongation, the C content is preferably more than 0.80%, further preferably 0.85% or more. Also, the C content is preferably 1.30% or less, further preferably 1.25% or less.

Si: 0.05 to 1.00%

Silicon (Si) is an element necessary for deoxidation of steel. If the content of Si is less than 0.05%, the deoxidation is insufficient and many nonmetallic inclusions remain, and therefore desired SSC resistance cannot be achieved. On the other hand, if the content of Si is more than 1.0%, the grain boundary strength is weakened, and the SSC resistance is decreased. Therefore, the content of Si is set to 0.05 to 1.00%. The Si content is preferably 0.10% or more, further preferably 0.20% or more. Also, the Si content is preferably 0.80% or less, further preferably 0.60% or less.

Mn: 12 to 25%

Manganese (Mn) is an element capable of stabilizing austenite phase at a low cost. In order to exert the effect in the present invention, 12% or more of Mn has to be contained. On the other hand, Mn dissolves preferentially in wet hydrogen sulfide environments, and stable corrosion products are not formed on the surface of material. As a result, the general corrosion resistance is deteriorated with the increase in the Mn content. If more than 25% of Mn is contained, the corrosion rate becomes higher than the standard corrosion rate of low-alloy oil well pipe. Therefore, the Mn content has to be set to 25% or less.

In the present invention, the "standard corrosion rate of low-alloy oil well pipe" means a corrosion rate converted from the corrosion loss at the time when a steel is immersed in solution A (5% NaCl+0.5% $CH_3COOH$ aqueous solution, 1-bar $H_2S$ saturated) specified in NACE TM0177-2005 for 336 h, being 1.5 g/($m^2$·h).

Al: 0.003 to 0.06%

Aluminum (Al) is an element necessary for deoxidation of steel, and therefore 0.003% or more of Al has to be contained. However, if the content of Al is more than 0.06%, oxides are liable to be mixed in as inclusions, and the oxides may exert an adverse influence on the toughness and corrosion resistance. Therefore, the Al content is set to 0.003 to 0.06%. The Al content is preferably 0.008% or more, further preferably 0.012% or more. Also, the Al content is preferably 0.05% or less, further preferably 0.04% or less. In the present invention, Al means acid-soluble Al (sol.Al).

P: 0.03% or Less

Phosphorus (P) is an element existing unavoidably in steel as an impurity. However, if the content of P is more than 0.03%, P segregates at grain boundaries, and deteriorates the SSC resistance. Therefore, the content of P has to be set to 0.03% or less. The P content is desirably as low as possible, being preferably 0.02% or less, further preferably 0.012% or less. However, an excessive decrease in the P content leads to a rise in production cost of steel material. Therefore, the lower limit of the P content is preferably 0.001%, further preferably 0.005%.

S: 0.03% or Less

Sulfur (S) exists unavoidably in steel as an impurity like P. If the content of S is more than 0.03%, S segregates at grain boundaries and forms sulfide-based inclusions, and therefore deteriorates the SSC resistance. Therefore, the content of S has to be set to 0.03% or less. The S content is desirably as low as possible, being preferably 0.015% or less, further preferably 0.01% or less. However, an excessive decrease in the S content leads to a rise in production cost of steel material. Therefore, the lower limit of the S content is preferably 0.001%, further preferably 0.002%.

N: Less than 0.10%

Nitrogen (N) is usually handled as an impurity element in iron and steel materials, and is decreased by denitrification. Since N is an element for stabilizing austenite phase, a large amount of N may be contained to stabilize austenite. However, since the present invention intends to stabilize austenite by means of C and Mn, N need not be contained positively. Also, if N is contained excessively, the high-temperature strength is raised, the work stress at high temperatures is increased, and the hot workability is deteriorated. Therefore, the content of N has to be set to less than 0.10%. From the viewpoint of refining cost, denitrification need not be accomplished unnecessarily, so that the lower limit of the N content is preferably 0.0015%.

Cr: 0% or More and Less than 5.0%

Chromium (Cr) may be contained as necessary because it is an element for improving the general corrosion resistance. However, if the content of Cr is 5.0% or more, Cr segregates at grain boundaries, and thereby the SSC resistance is deteriorated. Further, the stress corrosion cracking resistance (SCC resistance) may be deteriorated. Therefore, the content of Cr, if being contained, is set to less than 5.0%. The Cr content is preferably less than 4.5%, further preferably less than 3.5%. In the case where it is desired to achieve the above-described effect, the Cr content is preferably set to 0.1% or more, further preferably set to 0.2% or more, and still further preferably set to 0.5% or more.

Mo: 0% or More and Less than 3.0%

Molybdenum (Mo) may be contained as necessary because it is an element for stabilizing corrosion products in wet hydrogen sulfide environments and for improving the general corrosion resistance. However, if the content of Mo is 3% or more, the SSC resistance and SCC resistance may be deteriorated. Also, since Mo is a very expensive element, the content of Mo, if being contained, is set to less than 3.0%. In the case where it is desired to achieve the above-described effect, the Mo content is preferably set to 0.1% or more, further preferably set to 0.2% or more, and still further preferably set to 0.5% or more.

Cu: 0% or More and Less than 1.0%

Copper (Cu) may be contained as necessary, if in a small amount, because it is an element capable of stabilizing austenite phase. However, in the case where the influence on the corrosion resistance is considered, Cu is an element that promotes local corrosion, and is liable to form a stress concentrating zone on the surface of steel material. Therefore, if Cu is contained excessively, the SSC resistance and SCC resistance may be deteriorated. For this reason, the content of Cu, if being contained, is set to less than 1.0%. In the case where it is desired to achieve the effect of stabilizing austenite, the Cu content is preferably set to 0.1% or more, further preferably set to 0.2% or more.

Ni: 0% or More and Less than 1.0%

Nickel (Ni) may be contained as necessary, if in a small amount, because it is an element capable of stabilizing austenite phase as is the case with Cu. However, in the case where the influence on the corrosion resistance is considered, Ni is an element that promotes local corrosion, and is liable to form a stress concentrating zone on the surface of steel material. Therefore, if Ni is contained excessively, the SSC resistance and SCC resistance may be deteriorated. For this reason, the content of Ni, if being contained, is set to less than 1.0%. In the case where it is desired to achieve the effect of stabilizing austenite, the Ni content is preferably set to 0.1% or more, further preferably set to 0.2% or more.

V: 0 to 0.5%

Nb: 0 to 0.5%

Ta: 0 to 0.5%

Ti: 0 to 0.5%

Zr: 0 to 0.5%

Vanadium (V), niobium (Nb), tantalum (Ta), titanium (Ti) and zirconium (Zr) may be contained as necessary because these are elements that contribute to the strength of the steel by combining with C or N to form micro carbides or carbonitrides. The steel material of the present invention is intended to be strengthened by cold working after solid solution treatment. In addition the steel material can be strengthened by precipitation strengthening during aging heat treatment when the elements having abilities to faun carbides and carbonitrides are contained. However, if these elements are contained excessively, the effect is saturated and deterioration of toughness and destabilization of austenite may be caused. Therefore, the content of each element is 0.5% or less. In order to obtain the effect, the content of one or more elements selected from these elements is preferably 0.005% or more, further preferably 0.1% or more.

Ca: 0% or more and less than 0.005%

Mg: 0% or more and less than 0.005%

Calcium (Ca) and magnesium (Mg) may be contained as necessary because these are elements that have effects to improve toughness and corrosion resistance by controlling the form of inclusions, and further enhance casting properties by suppressing nozzle clogging during casting. However, if these elements are contained excessively, the effect is saturated and the inclusions are liable to be clustered to deteriorate toughness and corrosion resistance. Therefore, the content of each element is less than 0.005%. The content of each element is preferably 0.003% or less. When both Ca and Mg are contained the total content of these elements is preferable less than 0.005%. In order to obtain the effect, the content of one or two elements from these elements is preferably 0.0003% or more, further preferably 0.0005% or more.

B: 0 to 0.015%

Boron (B) may be contained as necessary because this is an element that has effects to refine the precipitates and the austenite grain size. However, if B is contained excessively, low-melting-point compounds may be formed to deteriorate hot workability. Especially, if the B content is more than 0.015%, the hot workability may be deteriorated remarkably. Therefore, the B content is 0.015% or less. In order to obtain the effect, the B content is preferably 0.0001% or more.

The high-strength steel material for oil well of the present invention has the chemical composition consisting of the elements ranging from C to B, the balance being Fe and impurities.

The term "impurities" means components that are mixed in on account of various factors in the production process including raw materials such as ore and scrap when the steel is produced on an industrial basis, which components are allowed in the range in which the components does not exert an adverse influence on the present invention.

Nieq: 27.5 or Higher

Nieq means Ni equivalent, and is defined by the following Formula (i). In the present invention, the high strength of steel material can be attained by cold working. However, in the case where austenite phase is not stable, strain induced α' martensite is formed, and thereby the SSC resistance is deteriorated remarkably. Even in the case where the steel material has the above-described chemical composition, if both of the contents of C and Mn are low, the austenite phase becomes unstable. Therefore, for the steel material of the present invention, to stabilize the austenite phase sufficiently, the chemical composition must be regulated so that the Nieq represented by Formula (i) is 27.5 or higher. The Nieq is preferably set to 29 or higher, further preferably set to 32 or higher.

$$Nieq=Ni+30C+0.5Mn \quad (i)$$

where, the symbol of an element in the formula represents the content (mass %) of the element contained in the steel material, and is made zero in the case where the element is not contained.

2. Metal Micro-Structure

As described above, if α' martensite and ferrite each having a BCC structure are intermixed in the metal micro-structure, the SSC resistance is deteriorated. In particular, if the total volume fraction of the α' martensite and ferrite is 0.1% or more, the SSC resistance is deteriorated remarkably. Considering this point, in the present invention, the metal micro-structure is made a structure consisting mainly of an FCC structure, and the total volume fraction of the α' martensite and ferrite is defined as less than 0.1%.

In the present invention, as a structure consisting mainly of an FCC structure, the intermixing of ε martensite of an HCP structure besides an FCC structure serving as a matrix of steel is allowed. The volume fraction of ε martensite is preferably 10% or less.

Since the α' martensite and ferrite exist in the metal micro-structure as fine crystals, it is difficult to measure the volume fraction thereof by means of X-ray diffraction, microscope observation or the like. Therefore, in the present invention, the total volume fraction of the structure having a BCC structure is measured by using a ferrite meter.

Since Nieq defined by Formula (i) is made 27.5 or higher, the steel material according to the present invention has a metal micro-structure consisting mainly of austenite in the state after solid solution heat treatment. To realize a yield strength of 862 MPa or higher, the steel material according to the present invention is strengthened by cold working. In the case where an austenitic steel is cold-worked, a part of austenite is sometimes transformed by strain induced transformation.

The steel material according to the present invention has a possibility of being subjected to ε martensitic transformation by strain induced transformation; however, even if α' martensite is formed, the formation is suppressed to a very small amount. Also, since the ε martensite has an HCP structure, even if ε martensite is formed, hydrogen embrittlement does not occur, and the SSC resistance is not adversely affected. That is to say, for the steel material of the present invention, even if strain induced transformation occurs, α' martensite is scarcely focused, so that the SSC resistance is less liable to be deteriorated.

3. Mechanical Properties

The steel material according to the present invention is a high-strength steel material for oil well having a yield strength of 862 MPa or higher. As described above, the SSC resistance deteriorates rapidly with the rise in the strength of steel; however, in the steel material according to the present invention, a yield strength as high as 862 MPa and excellent SSC resistance can be compatible with each other. Also, when the yield strength is 965 MPa or higher, the high-strength steel material for oil well according to the present invention further achieves the effects thereof.

The high-strength steel material for oil well according to the present invention has a feature of having a large elongation even when being cold-worked at a high working ratio. The steel material according to the present invention exhibits an elongation (elongation after fracture) of preferably 15% or more, further preferably 20% or more.

4. Production Method

The method for producing the steel material according to the present invention is not subject to any special restriction as far as the above-described strength can be given by the method. For example, the method described below can be employed.

<Melting and Casting>

Concerning melting and casting, a method carried out in the method for producing general austenitic steel materials can be employed, and either ingot casting or continuous casting can be used. In the case where seamless steel pipes are produced, a steel may be cast into a round billet form for pipe making by round continuous casting.

<Hot Working (Forging, Piercing, Rolling)>

After casting, hot working such as forging, piercing, and rolling is performed. In the production of seamless steel pipes, in the case where a circular billet is cast by the round continuous casting, processes of forging, blooming, and the like for forming the circular billet are unnecessary. In the case where the steel material is a seamless steel pipe, after the piercing process, rolling is performed by using a mandrel mill or a plug mill. Also, in the case where the steel material is a plate material, the process is such that, after a slab has been rough-rolled, finish rolling is performed. The desirable conditions of hot working such as piercing and rolling are as described below.

The heating of billet may be performed to a degree such that hot piercing can be performed on a piercing-rolling mill; however, the desirable temperature range is 1000 to 1250° C. The piercing-rolling and the rolling using a mill such as a mandrel mill or a plug mill are also not subject to any special restriction. However, from the viewpoint of hot workability, specifically, to prevent surface defects, it is desirable to set the finishing temperature at 900° C. or higher. The upper limit of finishing temperature is also not subject to any special restriction; however, the finishing temperature is preferably lower than 1100° C.

In the case where a steel plate is produced, the heating temperature of a slab or the like is enough to be in a temperature range in which hot rolling can be performed, for example, in the temperature range of 1000 to 1250° C. The pass schedule of hot rolling is optional. However, considering the hot workability for reducing the occurrence of surface defects, edge cracks, and the like of the product, it is desirable to set the finishing temperature at 900° C. or higher. The finishing temperature is preferably lower than 1100° C. as in the case of seamless steel pipe.

<Solid Solution Heat Treatment>

The steel material having been hot-worked is heated to a temperature enough for carbides and the like to be dissolved completely, and thereafter is rapidly cooled. In this case, it is necessary that the steel material be rapidly cooled after being held in the temperature range of 1000 to 1200° C. for 10 min or longer. That is, if the heating temperature is lower than 1000° C., carbides, especially Cr—Mo based carbides in the case where Cr and Mo are contained, cannot be dissolved completely. Therefore, a Cr and Mo deficient layer is formed around the Cr—Mo based carbide, and stress corrosion cracking caused by the occurrence of pitting occurs, so that in some cases, desired SSC resistance cannot be achieved. On the other hand, if the heating temperature is higher than 1200° C., a heterogeneous phase of ferrite and the like is precipitated, so that in some cases, desired SSC resistance cannot be achieved. Also, if the holding time is shorter than 10 min, the effect of forming solid solution is insufficient, and carbides cannot be dissolved completely. Therefore, in some cases, desired SSC resistance cannot be achieved for the same reason as that in the case where the heating temperature is lower than 1000° C.

The upper limit of the holding time depends on the size and shape of steel material, and cannot be determined unconditionally. Anyway, the time for soaking the whole of steel material is necessary. From the viewpoint of reducing the production cost, too long time is undesirable, and it is proper to usually set the time within 1 h. Also, concerning cooling, to prevent carbides (mainly, Cr—Mo based carbides) during cooling, other intermetallic compounds, and the like from precipitating, the steel material is desirably cooled at a cooling rate higher than the oil cooling rate.

The lower limit value of the holding time is holding time in the case where the steel material is reheated to the temperature range of 1000 to 1200° C. after the steel material having been hot-worked has been cooled once to a temperature lower than 1000° C. However, in the case where the finish temperature of hot working (finishing temperature) is made in the range of 1000 to 1200° C., if supplemental heating is performed at that temperature for 5 min or longer, the same effect as that of solid solution heat treatment performed under the above-described conditions can be achieved, so that rapid cooling can be performed as it is without reheating. Therefore, the lower limit value of the holding time in the present invention includes the case where the finish temperature of hot working (finishing temperature) is made in the range of 1000 to 1200° C., and supplemental heating is performed at that temperature for 5 min or longer.

<Aging Heat Treatment>

The present steel material is basically strengthened by cold working after solid solution heating. However, aging heat treatment can be performed before cold working process, for the purpose of precipitation strengthening by mainly precipitating carbides and carbonitrides. In particular, it is effective in the case where one or more elements selected from V, Nb, Ta, Ti and Zr is contained. However, exceeding aging heat treatment induces formation of excess carbides and reduce C concentration in parent phase to lead destabilization of austenite. As a heating condition, it is preferable to heat the steel material about several ten min to several h at the temperature range of 600 to 800° C.

<Cold Working>

The steel material having been subjected to solid solution heat treatment or further aging heat treatment is cold-worked to realize the target yield strength, a strength of 862 MPa (125 ksi) or higher. In this case, it is preferable to perform cold working at a working ratio (reduction of area) of 20% or higher. In order to obtain a high strength of 965 MPa or higher, it is preferable to make the working ratio 30% or higher. Since the steel material according to the present invention holds a high ductility even after being heavily worked, even if the working ratio is increased to 40%, cold working can be performed without the occurrence of fine cracks and the like on the surface.

The cold working method is not subject to any special restriction as far as the steel material can be worked evenly by the method. However, in the case where the steel material is a steel pipe, it is advantageous on an industrial basis to use a so-called cold draw bench using a holed die and a plug, a cold rolling mill called a cold Pilger rolling mill, or the like. Also, in the case where the steel material is a plate material, it is advantageous on an industrial basis to use a rolling mill that has been used to produce the ordinary cold rolled plate.

<Annealing>

After the cold working, annealing can be performed. In particular, annealing can be applied with a view to reducing a strength when the excess strength is obtained by the cold working, and recovering an elongation. As an annealing condition, it is preferable to heat the steel material about several min to 1 h at the temperature range of 300 to 500° C.

Hereunder, the present invention is explained more specifically with reference to examples; however, the present invention is not limited to these examples.

Example 1

Thirty-five kinds of steels of A to V and AA to AM having the chemical compositions given in Table 1 were melted in a 50 kg vacuum furnace to produce ingots. Each of the ingots was heated at 1180° C. for 3 h, and thereafter was forged and cut by electrical discharge cutting-off. Thereafter, the cut ingot was further soaked at 1150° C. for 1 h, and was hot-rolled into a plate material having a thickness of 20 mm Subsequently, the plate material was subjected to solid solution heat treatment at 1100° C. for 1 h. Finally, the plate material was cold-rolled up to 50% reduction in thickness ("reduction of thickness" is substantially equal to "reduction of area" in this case) to obtain a test material.

TABLE 1

| | Chemical composition (in mass %, balance; Fe and impurities) | | | | | | | | | | |
|---|---|---|---|---|---|---|---|---|---|---|---|
| Steel | C | Si | Mn | Al | P | S | N | Cr | Mo | Cu | Ni |
| A | 1.21 | 0.31 | 20.17 | 0.020 | 0.010 | 0.006 | 0.003 | — | — | — | — |
| B | 1.23 | 0.40 | 23.92 | 0.032 | 0.010 | 0.004 | 0.003 | — | — | — | — |
| C | 0.88 | 0.22 | 19.64 | 0.011 | 0.014 | 0.007 | 0.004 | — | — | — | — |
| D | 0.80 | 0.50 | 22.98 | 0.012 | 0.008 | 0.006 | 0.002 | — | — | — | — |
| E | 0.62 | 0.51 | 24.07 | 0.012 | 0.008 | 0.006 | 0.003 | — | — | — | — |
| F | 0.60 | 0.32 | 19.97 | 0.009 | 0.010 | 0.006 | 0.002 | — | — | — | — |
| G | 1.18 | 0.41 | 12.53 | 0.033 | 0.009 | 0.004 | 0.003 | 4.06 | — | — | — |
| H | 1.22 | 0.41 | 15.95 | 0.030 | 0.010 | 0.005 | 0.005 | 1.98 | — | — | — |
| I | 0.81 | 0.51 | 15.02 | 0.011 | 0.009 | 0.005 | 0.003 | — | 2.11 | — | — |
| J | 0.77 | 0.50 | 19.14 | 0.011 | 0.009 | 0.006 | 0.003 | — | 0.98 | — | — |
| K | 0.99 | 0.21 | 15.02 | 0.010 | 0.005 | 0.003 | 0.050 | — | — | 0.50 | 0.50 |
| L | 1.00 | 0.23 | 15.23 | 0.052 | 0.005 | 0.004 | 0.004 | 2.12 | 1.94 | — | — |
| M | 0.91 | 0.27 | 19.79 | 0.017 | 0.014 | 0.005 | 0.069 | 0.10 | 0.05 | 0.05 | 0.20 |
| N | 0.98 | 0.21 | 16.24 | 0.020 | 0.009 | 0.004 | 0.003 | — | — | — | — |
| O | 0.99 | 0.18 | 15.90 | 0.016 | 0.009 | 0.004 | 0.005 | — | — | — | — |
| P | 0.96 | 0.16 | 16.13 | 0.028 | 0.010 | 0.005 | 0.005 | — | — | — | — |
| Q | 0.99 | 0.22 | 16.05 | 0.022 | 0.009 | 0.004 | 0.006 | — | — | — | — |
| R | 0.95 | 0.15 | 15.88 | 0.031 | 0.011 | 0.004 | 0.005 | — | — | — | — |
| S | 1.17 | 0.31 | 19.64 | 0.032 | 0.012 | 0.005 | 0.003 | 0.28 | 0.31 | — | — |
| T | 1.21 | 0.33 | 19.55 | 0.033 | 0.011 | 0.004 | 0.003 | 0.51 | 0.49 | — | — |
| U | 1.17 | 0.28 | 19.82 | 0.026 | 0.009 | 0.004 | 0.004 | 1.01 | 0.98 | — | — |
| V | 1.18 | 0.27 | 20.04 | 0.031 | 0.010 | 0.006 | 0.002 | 0.48 | 0.52 | 0.49 | 0.48 |
| AA | 1.19 | 0.32 | 9.98 * | 0.019 | 0.008 | 0.003 | 0.002 | — | — | — | — |
| AB | 1.01 | 0.29 | 10.07 * | 0.019 | 0.010 | 0.003 | 0.003 | 4.97 | — | — | — |
| AC | 0.49 * | 0.25 | 12.13 | 0.035 | 0.006 | 0.003 | 0.003 | — | — | — | — |
| AD | 0.51 * | 0.26 | 19.85 | 0.033 | 0.005 | 0.005 | 0.003 | — | — | — | — |
| AE | 0.78 | 0.50 | 11.09 * | 0.012 | 0.007 | 0.006 | 0.004 | — | 3.09 * | — | — |
| AF | 0.70 | 0.26 | 12.05 | 0.034 | 0.005 | 0.003 | 0.004 | — | — | — | — |
| AG | 0.51 * | 0.24 | 27.92 * | 0.032 | 0.005 | 0.003 | 0.003 | — | — | — | — |
| AH | 1.21 | 0.42 | 28.12 * | 0.036 | 0.009 | 0.004 | 0.005 | — | — | — | — |
| AI | 0.80 | 0.48 | 27.19 * | 0.011 | 0.008 | 0.005 | 0.006 | — | — | — | — |
| AJ | 0.98 | 0.21 | 14.92 | 0.049 | 0.005 | 0.004 | 0.005 | 5.95 * | — | — | — |
| AK | 1.00 | 0.21 | 14.95 | 0.051 | 0.006 | 0.003 | 0.003 | — | 5.88 * | — | — |
| AL | 1.01 | 0.20 | 14.89 | 0.051 | 0.006 | 0.003 | 0.002 | — | — | 3.07 * | — |
| AM | 1.01 | 0.23 | 15.11 | 0.055 | 0.005 | 0.004 | 0.003 | — | — | — | 2.99 * |

| | Chemical composition (in mass %, balance; Fe and impurities) | | | | | | | | |
|---|---|---|---|---|---|---|---|---|---|
| Steel | V | Nb | Ta | Ti | Zr | Ca | Mg | B | Nicq |
| A | — | — | — | — | — | — | — | — | 46.4 |
| B | — | — | — | — | — | — | — | — | 48.9 |
| C | — | — | — | — | — | — | — | — | 36.2 |
| D | — | — | — | — | — | — | — | — | 35.5 |

TABLE 1-continued

| | | | | | | | | | |
|---|---|---|---|---|---|---|---|---|---|
| E | — | — | — | — | — | — | — | — | 30.6 |
| F | — | — | — | — | — | — | — | — | 28.0 |
| G | — | — | — | — | — | — | — | — | 41.7 |
| H | — | — | — | — | — | — | — | — | 44.6 |
| I | — | — | — | — | — | — | — | — | 31.8 |
| J | — | — | — | — | — | — | — | — | 32.7 |
| K | — | — | — | — | — | — | — | — | 37.7 |
| L | — | — | — | — | — | — | — | — | 37.6 |
| M | 0.19 | 0.03 | — | — | — | — | — | — | 37.4 |
| N | 0.45 | — | — | — | — | — | — | — | 37.5 |
| O | — | 0.48 | — | — | — | — | — | — | 37.7 |
| P | — | — | 0.42 | — | — | — | — | — | 36.9 |
| Q | — | — | — | 0.19 | — | — | — | — | 37.7 |
| R | — | — | — | — | 0.21 | — | — | — | 36.4 |
| S | — | — | — | — | — | 0.003 | — | — | 44.9 |
| T | — | — | — | — | — | — | 0.002 | — | 46.1 |
| U | — | — | — | — | — | 0.002 | 0.001 | — | 45.0 |
| V | — | — | — | — | — | — | — | 0.001 | 45.9 |
| AA | — | — | — | — | — | — | — | — | 40.7 |
| AB | — | — | — | — | — | — | — | — | 35.3 |
| AC | — | — | — | — | — | — | — | — | 20.8 * |
| AD | — | — | — | — | — | — | — | — | 25.2 * |
| AE | — | — | — | — | — | — | — | — | 28.9 |
| AF | — | — | — | — | — | — | — | — | 27.0 * |
| AG | — | — | — | — | — | — | — | — | 29.3 |
| AH | — | — | — | — | — | — | — | — | 50.4 |
| AI | — | — | — | — | — | — | — | — | 37.6 |
| AJ | — | — | — | — | — | — | — | — | 36.9 |
| AK | — | — | — | — | — | — | — | — | 37.5 |
| AL | — | — | — | — | — | — | — | — | 37.7 |
| AM | — | — | — | — | — | — | — | — | 40.8 |

* indicates that conditions do not satisfy those defined by the present invention.

On the obtained test material, first, the total volume ratio of ferrite and α' martensite was measured by using a ferrite meter (model number: FE8e3) manufactured by Helmut Fischer. On the obtained test specimen, α' martensite and ε martensite were confirmed by X-ray diffraction. However, on all of the test specimens, the existence of these kinds of martensite could not be detected with the X-ray diffraction.

By using the above-described test materials, the SSC resistance, the SCC resistance, and the mechanical properties were examined. The SSC resistance and SCC resistance were evaluated by using a round-bar type tensile test specimen (parallel part: 6.35 mm in diameter×25.4 mm in length) sampled from the L direction (rolling direction) of the test material. The load stress was made 90% of the measured value of the yield strength of base metal. The reason why the SCC resistance was evaluated is as described below.

As one kind of environment cracks of an oil well pipe occurring in the oil well, inherently, attention must be paid to SCC (stress corrosion cracking). The SCC is a phenomenon in which cracks are propagated by local corrosion, and is caused by partial fracture of the protection film on the surface of material, grain-boundary segregation of alloying element, and the like. Conventionally, SCC has scarcely been studied from the view point of the SCC resistance because corrosion advances wholly in a low-alloy oil well pipe having tempered martensite, and the excessive adding of alloying element that brings about grain-boundary segregation leads to the deterioration in SCC resistance. Further, sufficient findings have not necessarily been obtained concerning the SCC susceptibility of a steel equivalent or similar to the steel material of the present invention, which has a component system vastly different from that of low-alloy steel, and has austenitic structure. Therefore, an influence of component on the SCC susceptibility and the like must be clarified.

The SSC resistance was evaluated as described below. A plate-shaped smooth test specimen was sampled, and a stress corresponding to 90% of yield stress was applied to one surface of the test specimen by four-point bending method. Thereafter, the test specimen was immersed in a test solution, that is, solution A (5% NaCl+0.5% $CH_3COOH$ aqueous solution, 1-bar $H_2S$ saturated) specified in NACE TM0177-2005, and was held at 24° C. for 336 h. Subsequently, it was judged whether or not rupture occurred. As the result, a not-ruptured steel material was evaluated so that the SSC resistance is good (referred to as "NF" in Table 2), and a ruptured steel material was evaluated so that the SSC resistance is poor (referred to as "F" in Table 2).

Concerning the SCC resistance as well, a plate-shaped smooth test specimen was sampled, and a stress corresponding to 90% of yield stress was applied to one surface of the test specimen by four-point bending method. Thereafter, the test specimen was immersed in a test solution, that is, the same solution A as described above, and was held in a test environment of 60° C. for 336 h. Subsequently, it was judged whether or not rupture occurred. As the result, a not-ruptured steel material was evaluated so that the SCC resistance is good (referred to as "NF" in Table 2), and a ruptured steel material was evaluated so that the SCC resistance is poor (referred to as "F" in Table 2). This test solution is a test environment less liable to produce SSC because the temperature thereof is 60° C. and thereby the saturated concentration of $H_2S$ in the solution is decreased compared with that at normal temperature. Concerning the test specimen in which cracking occurred in this test, whether this cracking is SCC or SSC was judged by observing the propagation mode of crack under an optical microscope. Concerning the specimen of this test, it was confirmed that, for all of the test specimens in which cracking occurred in the above-described test environment, SCC had occurred.

Also, to evaluate the general corrosion resistance, the corrosion rate was determined by the method described below. The above-described test material was immersed in the solution A at normal temperature for 336 h, the corrosion loss was determined, and the corrosion loss was converted into the average corrosion rate.

Concerning the mechanical properties, yield strength and elongation were measured. From each of the steels, a round-bar tensile test specimen having a parallel part measuring 6 mm in outside diameter and 40 mm in length was sampled. A tension test was conducted at normal temperature (25° C.), whereby the yield strength YS (0.2% yield stress) (MPa) and the elongation (%) were determined.

These results are collectively given in Table 2. For the examination results of the total volume ratio of ferrite and α' martensite, the SSC resistance, the SCC resistance, and the corrosion rate, Table 2 gives the values of a test material having been subjected to 40% cold working. This is because, since these measurement results tend to be deteriorated with the increase in degree of cold working, evaluation is performed under severer condition.

Furthermore, concerning the yield strength and elongation, the values of a test material having been subjected to 30% cold working are given. This is because, if the degree of cold working is 30%, the yield strength and elongation can be provided without much trouble by using the general cold working facility, so that the obtained values can be judged to be realistic values.

TABLE 2

| Test No. | Steel | Volume fraction of BCC structure (%) | SSC resistance | SCC resistance | Corrosion rate ($g/m^2/h$) | Yield strength (MPa) | Elongation (%) | |
|---|---|---|---|---|---|---|---|---|
| 1 | A | 0.00 | NF | NF | 1.3 | 1131 | 26.8 | Inventive example |
| 2 | B | 0.00 | NF | NF | 1.4 | 1117 | 30.7 | |
| 3 | C | 0.00 | NF | NF | 1.3 | 1037 | 38.2 | |
| 4 | D | 0.00 | NF | NF | 1.4 | 1069 | 20.5 | |
| 5 | E | 0.00 | NF | NF | 1.5 | 1124 | 17.3 | |
| 6 | F | 0.00 | NF | NF | 1.3 | 927 | 28.8 | |
| 7 | G | 0.06 | NF | NF | 1.0 | 1138 | 19.4 | |
| 8 | H | 0.02 | NF | NF | 1.2 | 1124 | 21.3 | |
| 9 | I | 0.05 | NF | NF | 1.2 | 1034 | 15.8 | |
| 10 | J | 0.01 | NF | NF | 1.3 | 1048 | 18.7 | |
| 11 | K | 0.00 | NF | NF | 1.1 | 993 | 16.8 | |
| 12 | L | 0.00 | NF | NF | 1.0 | 1014 | 23.4 | |
| 13 | M | 0.00 | NF | NF | 1.2 | 1121 | 25.2 | |
| 14 | N | 0.00 | NF | NF | 1.1 | 1180 | 19.6 | |
| 15 | O | 0.00 | NF | NF | 1.2 | 1158 | 18.8 | |
| 16 | P | 0.00 | NF | NF | 1.2 | 1136 | 17.8 | |
| 17 | Q | 0.00 | NF | NF | 1.2 | 1173 | 24.3 | |
| 18 | R | 0.00 | NF | NF | 1.3 | 1103 | 21.8 | |
| 19 | S | 0.00 | NF | NF | 1.3 | 1128 | 24.6 | |
| 20 | T | 0.00 | NF | NF | 1.3 | 1109 | 23.2 | |
| 21 | U | 0.00 | NF | NF | 1.4 | 1072 | 18.5 | |
| 22 | V | 0.00 | NF | NF | 1.4 | 1090 | 17.8 | |
| 23 | AA * | 0.19 * | F | NF | 1.1 | 1041 | 5.5 | Comparative example |
| 24 | AB * | 0.10 * | F | NF | 1.1 | 1089 | 16.8 | |
| 25 | AC * | 0.41 * | F | NF | 1.0 | 889 | 3.1 | |
| 26 | AD * | 0.22 * | F | NF | 1.4 | 917 | 7.6 | |
| 27 | AE * | 0.17 * | F | NF | 1.2 | 1000 | 5.2 | |
| 28 | AF * | 0.26 * | F | NF | 1.1 | 958 | 4.2 | |
| 29 | AG * | 0.03 | NF | NF | 1.7 | 986 | 29.1 | |
| 30 | AH * | 0.00 | NF | NF | 1.6 | 1089 | 28.8 | |
| 31 | AI * | 0.00 | NF | NF | 1.7 | 1041 | 24.2 | |
| 32 | AJ * | 0.00 | NF | F | 0.8 | 1110 | 20.4 | |
| 33 | AK * | 0.00 | F | F | 0.9 | 1055 | 21.2 | |
| 34 | AL * | 0.00 | NF | F | 1.2 | 1069 | 17.8 | |
| 35 | AM * | 0.00 | F | F | 0.7 | 1089 | 19.2 | |

* indicates that conditions do not satisfy those defined by the present invention.

From Table 2, it can be seen that for Test Nos. 1 to 22, which are example embodiments of the present invention, a yield strength of 862 MPa or higher can be provided by cold working at a working ratio of 30%, which can be performed without much trouble by using the conventional industrial facility. Also, even in the case where heavy working is performed at a working ratio of 40%, which is a severer condition, the SSC resistance and SCC resistance are excellent, and also the corrosion rate can be kept at 1.5 $g/(m^2 \cdot h)$, which is the target value, or lower.

On the other hand, for Test Nos. 23 to 27 in which the C content or the Mn content were lower than the lower limits defined in the present invention, the test result was such that the total volume fraction of BCC structure was 0.1% or more, and the SSC resistance was poor. Likewise, for Test No. 28, in which, although the contents of C and Mn were within the range defined in the present invention, the value of Nieq was lower than the lower limit defined in the present invention, the test result was such that the SSC resistance was poor.

Also, for Test Nos. 29 to 31 in which the Mn content was higher than the upper limit defined in the present invention, the test result was such that, although the SSC resistance was good, the corrosion rate was high, and the general corrosion resistance was poor. Besides, for Test No. 32 in which the Cr content was out of the defined range, and Test No. 34 in which the Cu content was out of the defined range, the test result was such that the SCC resistance was poor. For Test No. 33 in which the Mo content was out of the defined range, and Test No. 35 in which the Ni content was out of the defined range, the test result was such that the SSC resistance and SCC resistance were poor.

Figure 2:
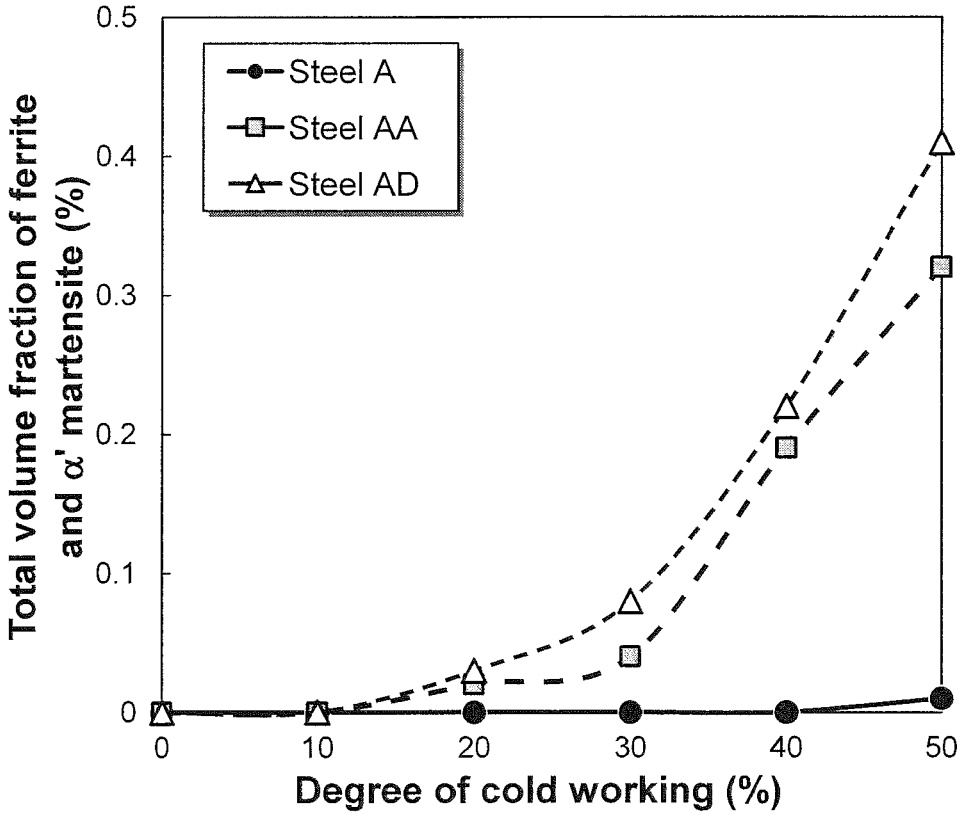
FIG. 2 is a graph showing the relationship between degree of cold working and total volume fraction of ferrite and α' martensite.

FIGS. 1 and 2 are graphs showing the elongation and the total volume fraction of ferrite and α' martensite, respectively, at the degree of cold working of 0 to 50% for steel A satisfying the definition of the present invention and steels AA and AD out of the defined range. As is also apparent from FIGS. 1 and 2, the steel material according to the present invention is excellent in elongation, and can keep the volume fraction of BCC structure low even in the case of being cold-worked at a high working ratio.

Example 2

Effects of aging heat treatment after solid solution treatment and before cold working, and annealing after cold working, respectively, were investigated using steels C, F and M after hot rolling which were prepared in EXAMPLE 1. The condition of solid solution heat treatment is same as EXAMPLE 1. Additionally the aging heat treatment is performed under the condition of 600° C. and 30 min, and the annealing is performed under the condition of 500° C. and 30 min. For Test Nos. 36 to 38, steels C, F and M were subjected to the aging heat treatment before cold working. On the other hand, for Test Nos. 39 to 41, similarly steels C, F and M were subjected to the annealing after cold working. The methods for cold working and evaluation test were same as EXAMPLE 1. Table 3 shows these results.

TABLE 3

| Test No. | Steel | Volume fraction of BCC structure (%) | SSC resistance | SSC resistance | Corrosion rate ($g/m^2/h$) | Yield strength (MPa) | Elongation (%) | |
|---|---|---|---|---|---|---|---|---|
| 36 | C | 0.00 | NF | NF | 1.3 | 1025 | 34.6 | Inventive example |
| 37 | F | 0.00 | NF | NF | 1.4 | 935 | 24.4 | |
| 38 | M | 0.00 | NF | NF | 1.2 | 1195 | 21.4 | |
| 39 | C | 0.00 | NF | NF | 1.2 | 988 | 37.8 | |
| 40 | F | 0.00 | NF | NF | 1.4 | 905 | 30.1 | |
| 41 | M | 0.00 | NF | NF | 1.3 | 1023 | 29.4 | |

Table 3 illustrates that it is effective to contain V and Nb because for Test No. 38 higher yield strength is achieved by performing aging heat treatment before cold working as compared to that of Test No. 13 for which steel M is used. In contrast, for Test Nos. 36 and 37 which used steels C and F containing neither V nor Nb, yield strengths are not enhanced as compared to those of Test Nos. 3 and 6 for which same steels are used. Additionally, for Test Nos. 39, 40 and 41 annealing is performed after cold working, resulting in decrease of the yield strengths of about 20 to 100 MPa and enhancement of the elongation of up to 4%.

INDUSTRIAL APPLICABILITY

According to the present invention, a steel material having a high strength and excellent SSC resistance can be obtained at a low cost by using the conventional industrial facility. Additionally, because of being also excellent in elongation, the steel material of the present invention is excellent in workability. Therefore, the high-strength steel material for oil well according to the present invention can be used suitably for oil well pipes in wet hydrogen sulfide environments.

What is claimed is:

1. A high-strength steel material for oil well having a chemical composition consisting, by mass percent, of C: 0.85 to 1.4%,
Si: 0.05 to 1.00%,
Mn: 12 to 25%,
Al: 0.003 to 0.06%,
P: 0.03% or less,
S: 0.03% or less,
N: less than 0.1%,
V: 0 to 0.5%,
Nb: 0 to 0.5%,
Ta: 0 to 0.5%,
Ti: 0 to 0.5%,
Zr: 0 to 0.5%,
Ca: 0% or more and less than 0.005%,
Mg: 0% or more and less than 0.005%,
B: 0 to 0.015%, and
one or more elements selected from
Cr: 0.1% or more and less than 5.0%,
Mo: 0.1% or more and less than 3.0%,
Cu: 0.1% or more and less than 1.0%, and
Ni: 0.1% or more and less than 1.0%, and
the balance: Fe and impurities,
wherein Nieq defined by the following Formula (i) is 32.7 or higher,
a metal micro-structure is a structure consisting of
a total volume fraction of ferrite and α' martensite: less than 0.10%,
a volume fraction of ε martensite: 10% or less,
the balance: an FCC structure, and
a yield strength is 862 MPa or higher;
the high-strength steel material for oil well, has
a) sulfide stress-corrosion cracking resistance (SSC resistance) defined as having no rupture after being immersed in Solution A for at 24° C. for 336 hours,
b) stress corrosion cracking resistance (SCC resistance) defined as having no rupture after being immersed in Solution A for at 60° C. for 336 hours, and
c) a corrosion rate of 1.5 $g/m^2h$ or lower after being immersed in Solution A for at 24° C. for 336 hours, wherein solution A is a 5% NaCl+0.5% $CH_3COOH$ aqueous solution, 1-bar $H_2S$ saturated, as specified in NACE TM0177-2005;

$$Nieq=Ni+30C+0.5Mn \quad (i)$$

where, each symbol Ni, C and Mn in the formula represents a content of the element contained in the high-strength steel material by mass percent, and is made zero in a case where the element is not contained.

2. A high-strength steel material for oil well having a chemical composition consisting, by mass percent, of C: 0.85 to 1.4%,
Si: 0.05 to 1.00%,
Mn: 12 to 25%,
Al: 0.003 to 0.06%,
P: 0.03% or less,
S: 0.03% or less,
N: less than 0.1%, and
one or more elements selected from
V: 0.005 to 0.5%, Nb: 0.005 to 0.5%,
Ta: 0.005 to 0.5%,
Ti: 0.005 to 0.5%,
Zr: 0.005 to 0.5%,
Ca: 0.0003% or more and less than 0.005%,
Mg: 0.0003% or more and less than 0.005% and
B: 0.0001 to 0.015%, and
one or more elements selected from
Cr: 0.1% or more and less than 5.0%,
Mo: 0.1% or more and less than 3.0%,
Cu: 0.1% or more and less than 1.0%, and
Ni: 0.1% or more and less than 1.0%, and
the balance: Fe and impurities,
wherein Nieq defined by the following Formula (i) is 32.7 or higher,
a metal micro-structure is a structure consisting of
a total volume fraction of ferrite and α' martensite: less than 0.10%,
a volume fraction of ε martensite: 10% or less,
the balance: an FCC structure, and
a yield strength is 862 MPa or higher;
the high-strength steel material for oil well, has
a) sulfide stress-corrosion cracking resistance (SSC resistance) defined as having no rupture after being immersed in Solution A for at 24° C. for 336 hours,
b) stress corrosion cracking resistance (SCC resistance) defined as having no rupture after being immersed in Solution A for at 60° C. for 336 hours, and
c) a corrosion rate of 1.5 $g/m^2h$ or lower after being immersed in Solution A for at 24° C. for 336 hours, wherein solution A is a 5% NaCl+0.5% $CH_3COOH$ aqueous solution, 1-bar $H_2S$ saturated, as specified in NACE TM0177-2005;

$$Nieq=Ni+30C+0.5Mn \quad (i)$$

where, each symbol Ni, C and Mn in the formula represents a content of the element contained in the high-strength steel material by mass percent, and is made zero in a case where the element is not contained.

3. The high-strength steel material for oil well according to claim 1, wherein the yield strength is 965 MPa or higher.

4. Oil well pipes, which are comprised of the high-strength steel material for oil well according to claim 1.

5. Oil well pipes, which are comprised of the high-strength steel material for oil well according to claim 3.

6. Oil well pipes, which are comprised of the high-strength steel material for oil well according to claim 2.

* * * * *